US006753661B2

(12) United States Patent
Muthu et al.

(10) Patent No.: US 6,753,661 B2
(45) Date of Patent: Jun. 22, 2004

(54) LED-BASED WHITE-LIGHT BACKLIGHTING FOR ELECTRONIC DISPLAYS

(75) Inventors: Subramanian Muthu, Ossining, NY (US); Frank J. Schuurmans, Valkenswaard (NL); Chin Chang, Yorktown Heights, NY (US); James Gaines, Mohegan Lake, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/173,346

(22) Filed: Jun. 17, 2002

(65) Prior Publication Data

US 2003/0230991 A1 Dec. 18, 2003

(51) Int. Cl.[7] ..... G05F 1/00

(52) U.S. Cl. ..... 315/307; 315/149; 315/224; 315/291; 315/312; 362/234; 362/253

(58) Field of Search ..... 315/291, 224, 315/307, 362, 149, 159, 312, 169.3; 362/234, 253, 800

(56) References Cited

U.S. PATENT DOCUMENTS

| | | | | | |
|---|---|---|---|---|---|
| 5,924,784 | A | * | 7/1999 | Chliwnyj et al. | 362/234 |
| 6,095,661 | A | * | 8/2000 | Lebens et al. | 362/184 |
| 6,439,731 | B1 | * | 8/2002 | Johnson et al. | 362/29 |
| 6,510,995 | B2 | * | 1/2003 | Muthu et al. | 235/454 |
| 2003/0076056 | A1 | * | 4/2003 | Schuurmans | 315/291 |

* cited by examiner

*Primary Examiner*—Haissa Philogene

(57) ABSTRACT

Apparatus and method for backlighting an electronic display with LEDs to control luminosity, radiometric power, and color levels by means of feedback control through a microprocessor, thereby maintaining white backlight at substantially constant levels, which can be chosen by an operator.

2 Claims, 2 Drawing Sheets

LED-BASED WHITE-LIGHT BACKLIGHTING FOR ELECTRONIC DISPLAYS

TECHNICAL FIELD

This invention relates in general to a backlight system for a liquid crystal (LCD) or other electronic display and, in particular, to controlling the color and lumen level of a red-green-blue (RGB) light-emitting diode (LED) backlight and the sensor(s) that control(s) such a backlight.

BACKGROUND AND SUMMARY OF THE INVENTION

Backlighting with white light generated by RGB LEDs is known to those skilled in the art. However, the characteristics of the LEDs vary with temperature, current, and aging. These characteristics also vary from one LED in a batch to another. Thus there is need for a feedback control to maintain within set limits the color and lumen level of such a backlighting system. For the feedback control to work satisfactorily, sensors must be placed properly to provide the necessary optical feedback.

The present invention provides apparatus and method for backlighting an electronic display with LEDs to control luminosity, radiometric power, and tristimulus levels by means of feedback control through a microprocessor, thereby maintaining the white backlight at substantially constant levels, which can be chosen by an operator.

In one embodiment of the invention, apparatus for backlighting an electronic display with white light comprises: a plurality of light-emitting diodes (LEDs), each of the LEDs effective for emitting light of a single color; at least one light source comprised of at least three of the LEDs arranged in a combination that produces white light; a light guide effective for illuminating the display with the white light; and circuitry effective for maintaining the white light at a substantially constant level of color and luminosity by controlling the at least one light source. This embodiment of the invention utilizes a method for backlighting an electronic display with white light comprising the steps of: driving a plurality of LEDs, each of the LEDs emitting light of a single color; combining light emitted from at least three of the LEDs to form white light; illuminating the display with the white light; and controlling the color and brightness of the white light by means of feedback circuitry.

In another embodiment of the invention there is provided apparatus for backlighting an electronic display with white light comprising means for driving a plurality of LEDs, each of the LEDs emitting light of a single color; means for combining light emitted from at least three of the LEDs to form white light; means for illuminating the display with the white light; means for controlling the color and brightness of the white light by feedback circuitry; and the means for controlling being subject to an operator's direction. The present invention addresses one or more of these concerns.

BRIEF DESCRIPTION OF THE DRAWINGS

In the accompanying drawings, like reference numerals designate corresponding elements or parts throughout, wherein.

DETAILED DESCRIPTION

Figure 1:
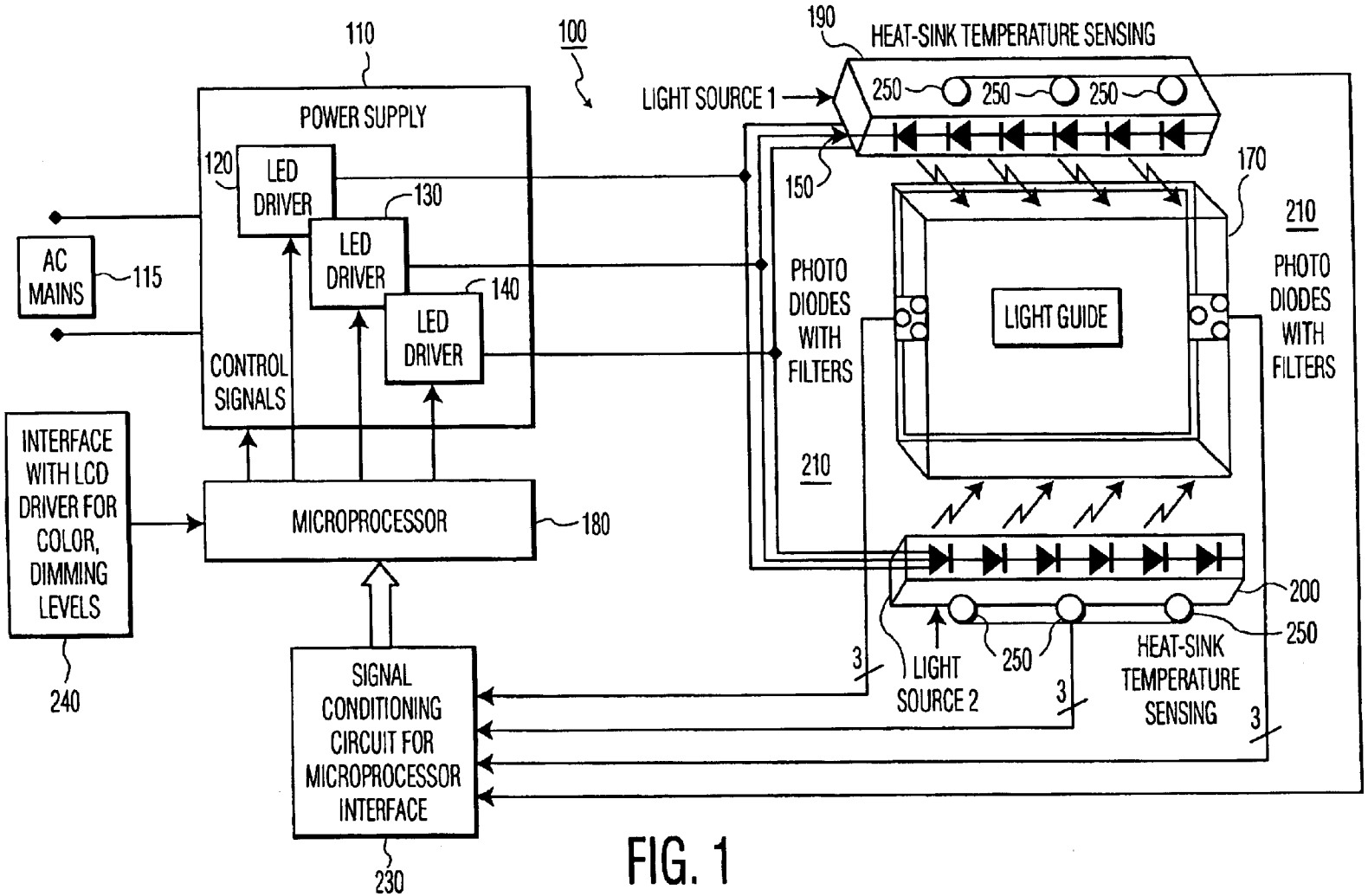
FIG. 1 illustrates the apparatus of the present invention for backlighting an LCD or other electronic display by means of RGB LEDs controlled by a microprocessor.

Referring to FIG. 1, there is illustrated an apparatus for controlling white light for substantially uniform backlighting of an LCD 100 or similar display, utilizing a power supply 110, which obtains power from an alternating current source 115. Power supply 110 further comprises a plurality of LED drivers 120, 130, 140, one each for red, green, and blue drivers, respectively. Each of LED drivers 120, 130, 140 is connected to a plurality of LEDs of the same color, connected in suitable series and parallel combinations, that comprise each of a plurality of light sources 150, 160.

Light sources 150, 160 are each embedded in a heat sink. 190, 200 to avoid overheating of LEDs and maximize uniformity of color. Light sources 150, 160 are in turn mounted on the edges of a light guide 170. Uniformity of color is maintained by forming a unit white cell on each of light sources 150, 160 in a suitable combination of LEDs, such as R-G-B, R-G-B-G, G-R-B, etc., that maximize uniformity of color. Optical arrangements couple the light from the LEDs of light sources 150, 160 to light guide 170.

LED drivers 120, 130, 140 supply current, suitably converted within power supply 110, to the LEDs in light sources 150, 160. A microprocessor 180, programmed with the functions necessary to control color and lumen level in light guide 170, provides signals that control the currents from LED drivers 120, 130, 140. A plurality of photo sensors 210 send feedback via a circuit 230 to permit microprocessor 180 to vary the signals sent to LED drivers 120, 130, 140. These signals may take the form of amplitude modulation, PWM signals, or other suitable values. A controller 240 feeds to microprocessor 180 signals that determine color and brightness levels of an LCD or other electronic display (not shown) backlit by light guide 170.

Feedback control is required to maintain color and brightness in light guide 170. Without such control, variations in the characteristics of the individual LEDs in light sources 150, 160 will cause the color and brightness in light guide 170 to vary within unacceptable limits. The feedback control required depends on taking appropriate samples by sensing.

In a first embodiment of the present invention, temperatures of light sources 150, 160 are sensed within heat sinks 190, 200. Microprocessor 180 is programmed to compensate for temperature-related variations in color and brightness in light guide 170 caused by variations in the characteristics of the LEDs in light sources 150, 160. This compensation is effected by adjusting the currents sent by LED drivers 120, 130, 140 to the LEDs. This first embodiment has no mechanism to overcome aging effects in the individual LEDs.

In a second embodiment of the present invention, photo diodes 210 measure at least one of either the lumen level and the radiometric power level in light guide 170 by unfiltered photo diodes, photo diodes with Y filters, or other suitable means. Microprocessor 180 is programmed to compensate for variations in color and brightness in light guide 170, caused by variations in the characteristics of the LEDs in light sources 150, 160, by adjusting the currents from LED drivers 120, 130, 140 to the desired levels of lumen and/or radiometric power. This second embodiment cannot overcome variations in color caused by variations in temperature.

In a third embodiment, both the temperatures in heat sinks 190, 200 and at least one of either the lumen level or the radiometric power level in light guide 170 are sensed as described in the first and second embodiments and fed to microprocessor 180. By programming microprocessor 180 to adjust the currents from LED drivers 120, 130, 140 in response to both sets of feedback stimuli, this embodiment of the present invention compensates for both aging and temperature variations in the LEDs in light sources 150, 160.

In a fourth embodiment, photo diodes 210 are fitted with appropriate filters to sense the tristimulus values of the white light in light guide 170. These tristimulus values (or another measure of color), fed back to a suitably programmed microcomputer 180, adjust the currents of LED drivers 120, 130, 140 to match the tristimulus values for the light in light guide 170 to match reference values.

In a fifth embodiment, temperatures in heat sinks 190, 200 are measured to add temperature compensation to the adjusted tristimulus values referred to in the fourth embodiment.

In all of the above embodiments, the color and lumen level of the white light from light guide 170 can be manually set by an operator or automatically by the control circuitry.

To insure uniformity of color, the sensors must be placed appropriately to provide the necessary feedback components for uniform color control. Referring again to FIG. 1, each of heat sinks 190, 200 has three temperature sensors 250. The placement of temperature sensors 250 on heat sinks 190, 200 depends on the latter's temperature profile. Feedback control is based on a weighted average of the outputs of temperature sensors 250.

A minimum of one pair of photo diodes 210 is required by the present invention, but their placement can vary. Referring again to FIG. 1, a first embodiment places each of a pair of photo diodes 210 in the middle of each of two sides of light guide 170.

Figure 2:
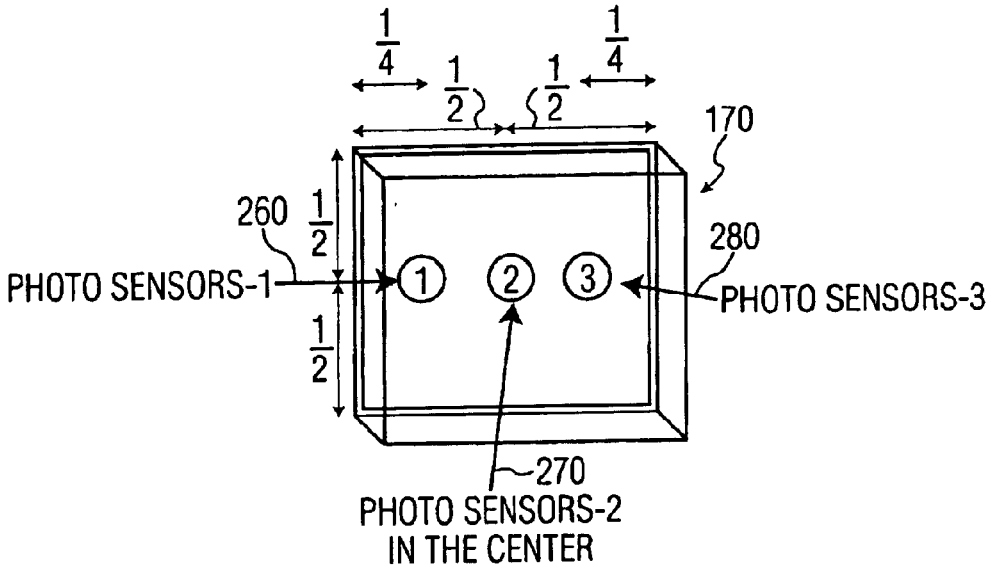
FIG. 2 illustrates the placement of photosensors in a light guide.

Referring to FIG. 2, a second embodiment places photo diodes 210 on the underside of light guide 170, between its body and the reflector below. The light in light guide 170 is sensed by at least one set of photo diodes 210, and the average from all of them is used by microprocessor 180. FIG. 2 shows three sets of photo sensors 260, 270, and 280. They are placed in a row substantially in the middle of a planar light guide 170, with photo sensors 270 in the middle of the row and photo sensors 260, 280 each placed approximately one-quarter of the distance from the side.

Figure 3:
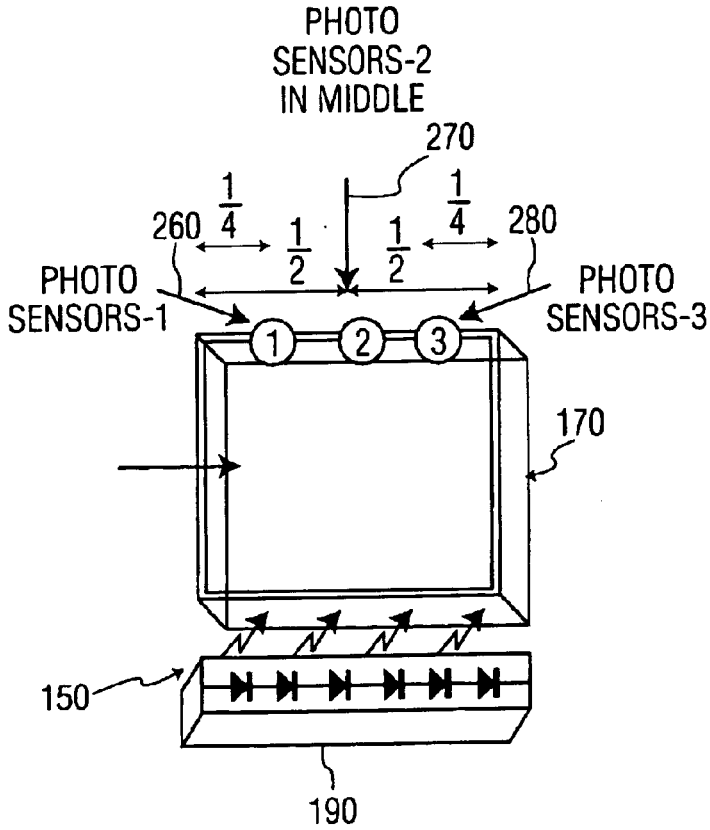
FIG. 3 illustrates placement of photosensors in a light guide when only a single side light source is used.

Referring to FIG. 3,in this embodiment only a single source can illuminate light guide 170, i.e., light source 150 is embedded in heat sink 190 for single-sided illumination of light guide 170, and there is no light source 160 as in FIG. 1. When light source 150 is alone, photo sensors 260, 270, 280 may be placed at the opposite edge of light guide 170 from light source 150. They are placed in a row with photo sensors 270 in the middle of the row and photo sensors 260, 280 each placed approximately one-quarter of the distance from the side.

Many other positions and numbers of photo diodes 210 and temperature sensors 250 are possible within the present invention.

Functional Description

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. Other aspects and features of the present invention can be obtained from a study of the drawings, the disclosure, and the appending claims.

What is claimed is:

1. An apparatus for backlighting an electronic display with white light, comprising:

a plurality of light-emitting diodes (LEDs), each of the LEDs being effective for emitting light of a single color;

at least one light source including at least three of said LEDs arranged in a combination that produces white light;

a light guide effective for illuminating the display with said white light; and circuitry, controllable automatically and/or manually, effective for maintaining the white light at a substantially constant level of color and luminosity by controlling the at least one light source, said circuitry including at least one set of photo diodes including three diodes placed an effective distance from each other in a row along an end of said light guide opposite a single at least one light source, a middle member of said set being placed substantially at the center of said end.

2. An apparatus for backlighting an electronic display with white light, comprising:

a plurality of light-emitting diodes (LEDs), each of the LEDs being effective for emitting light of a single color;

at least one light source including at least three of said LEDs arranged in a combination that produces white light;

a light guide effective for illuminating the display with said white light; and circuitry, controllable automatically and/or manually, effective for maintaining the white light at a substantially constant level of color and luminosity by controlling the at least one light source, said circuitry including at least one set of photo diodes including three diodes placed an effective distance from each other in a horizontal row substantially at the middle of said light guide, a middle member of said set being placed substantially at the center of said light guide and said at least one light source being a pair of light sources at respective ends of said light guide.

* * * * *